US010190529B1

(12) United States Patent
Nickols et al.

(10) Patent No.: US 10,190,529 B1
(45) Date of Patent: Jan. 29, 2019

(54) MARINE ENGINES HAVING CYLINDER BLOCK COOLING JACKET WITH SPACER

(71) Applicant: Brunswick Corporation, Lake Forest, IL (US)

(72) Inventors: Thomas F. Nickols, Oakfield, WI (US); Trevor George, Eldorado, WI (US); Vinodh Kumar Balakrishnan, Fon du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/726,618

(22) Filed: Oct. 6, 2017

(51) Int. Cl.
*F02B 75/18* (2006.01)
*F02F 1/14* (2006.01)
*F02F 1/16* (2006.01)

(52) U.S. Cl.
CPC ..... *F02F 1/14* (2013.01); *F02F 1/166* (2013.01)

(58) Field of Classification Search
CPC ..... F02F 1/14; F02F 1/166; F01P 2003/021
USPC ..... 123/41.74, 41.79, 41.72
See application file for complete search history.

(56) References Cited

U.S. PATENT DOCUMENTS

| | | | | |
|---|---|---|---|---|
| 5,207,189 | A | 5/1993 | Kawauchi et al. | |
| 6,138,619 | A * | 10/2000 | Etemad | F01P 3/02 123/41.74 |
| 6,834,625 | B2 * | 12/2004 | Matsutani | F01P 3/02 123/41.72 |
| 7,032,547 | B2 * | 4/2006 | Xin | F02F 1/108 123/41.72 |
| 7,216,611 | B2 * | 5/2007 | Matsutani | F02F 1/14 123/198 E |
| 7,438,026 | B2 | 10/2008 | Nakada et al. | |
| 7,740,433 | B2 * | 6/2010 | Miyoshi | F16B 43/001 411/371.1 |
| 8,402,930 | B1 | 3/2013 | Taylor et al. | |
| 8,474,418 | B2 | 7/2013 | Shikida et al. | |
| 8,763,568 | B2 * | 7/2014 | Hamakawa | F02F 1/163 123/41.21 |
| 9,624,816 | B2 * | 4/2017 | Matsumoto | F01P 3/02 |
| 9,803,534 | B2 * | 10/2017 | Marutani | F02F 1/166 |
| 2002/0000210 | A1 * | 1/2002 | Shinpo | F01P 3/02 123/41.74 |
| 2010/0031902 | A1 * | 2/2010 | Alyanak | F02F 1/14 123/41.44 |

FOREIGN PATENT DOCUMENTS

| | | |
|---|---|---|
| KR | 100980620 | 12/2009 |
| KR | 100980955 | 12/2009 |

* cited by examiner

*Primary Examiner* — Marguerite McMahon
*Assistant Examiner* — James Kim
(74) *Attorney, Agent, or Firm* — Andrus Intellectual Property Law, LLP

(57) ABSTRACT

A marine engine has a cylinder block having a plurality of cylinders. A cooling jacket is formed in the cylinder block and is configured to convey cooling fluid alongside the plurality of cylinders. The cooling jacket has a top end and a bottom end. A ledge is formed in the cylinder block. The ledge radially extends into cooling jacket at a location between the top end and the bottom end. A spacer is disposed in the cooling jacket and supported by the ledge so that the spacer remains spaced apart from the bottom end, thereby maintaining a lower cooling passage between the spacer and the bottom end.

17 Claims, 9 Drawing Sheets

MARINE ENGINES HAVING CYLINDER BLOCK COOLING JACKET WITH SPACER

FIELD

The present disclosure relates to marine engines, and more particularly to cooling of cylinder blocks in marine engines.

BACKGROUND

U.S. Pat. No. 5,207,189 discloses a cooling system for an internal combustion engine that eliminates stagnation of a coolant flowing in a plurality of annular passages formed between a cylinder block and a cylinder liner. Inflow and outflow passages are provided in the annular passages and extend in a direction of an axis of the cylinder liner. An inlet passage supplies a coolant to the inflow passage. A guiding member is provided at an entrance of each of the annular passages so as to lead a portion of a coolant to an upstream side of each of the annular passages. A sufficient amount of coolant flows through the annular passages of the cylinder liner, and thus the wall of the cylinder liner can be cooled efficiently.

U.S. Pat. No. 8,402,930 discloses a cooling system for a marine engine having various cooling channels and passages which allow the rates of flow of its internal streams of water to be preselected so that heat can be advantageously removed at varying rates for different portions of the engine. In addition, the direction of flow of cooling water through the various passages assists in the removal of heat from different portions of the engine at different rates so that overheating can be avoided in certain areas, such as the exhaust manifold and cylinder head, while overcooling is avoided in other areas, such as the engine block.

U.S. Pat. No. 8,474,418 discloses a passage separating member positioned in an axial direction of cylinder bores and causing a spacer to contact a bottom surface of a water jacket. When the separating member is inserted in the water jacket, the width of the separating member is reduced due to elastic deformation, so that the separating member can be arranged in the water jacket. After being arranged, the separating member tightly contacts the inner surface of the water jacket due to elastic restoration force. The tight contact prevents the separating member from moving upward in the water jacket. As a result, coolant is prevented from moving between the upper portion and the lower portion with respect to the separating member. The advantages of separate cooling of the coolant in the upper and lower portions with respect to the separating member are obtained. This reliably reduces the temperature difference along the axial direction of the cylinder bore forming body.

U.S. Pat. No. 8,763,568 discloses a spacer fitted inside a water jacket of a cylinder block in an internal combustion engine. The spacer is set so that a space formed between an inner peripheral surface of the spacer and an inner wall surface of the water jacket is smaller than a space formed between an outer peripheral surface of the spacer and an outer wall surface of the water jacket. Accordingly, even if the spacer is shifted in a radial direction, the inner peripheral surface of the spacer comes into abutment on the inner wall surface of the water jacket. Thereby, abutment of the outer peripheral surface of the spacer on the outer wall surface of the water jacket is prevented completely. Therefore, hitting sounds of pistons can be blocked by the space between the outer peripheral surface of the spacer and the outer wall surface of the water jacket.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. In certain examples disclosed herein, a marine engine has a cylinder block having a plurality of cylinders. A cooling jacket is formed in the cylinder block and is configured to convey cooling fluid alongside the plurality of cylinders. The cooling jacket has a top end and a bottom end. A ledge is formed in the cylinder block. The ledge radially extends into cooling jacket at a location between the top end and the bottom end. A spacer is disposed in the cooling jacket and supported by the ledge so that the spacer remains spaced apart from the bottom end, thereby maintaining a lower cooling passage between the spacer and the bottom end.

BRIEF DESCRIPTION OF THE DRAWINGS

The present disclosure is described with reference to the following figures. The same numbers are used throughout the figures to reference like features and like components.

DETAILED DESCRIPTION OF THE DRAWINGS

Figure 1:
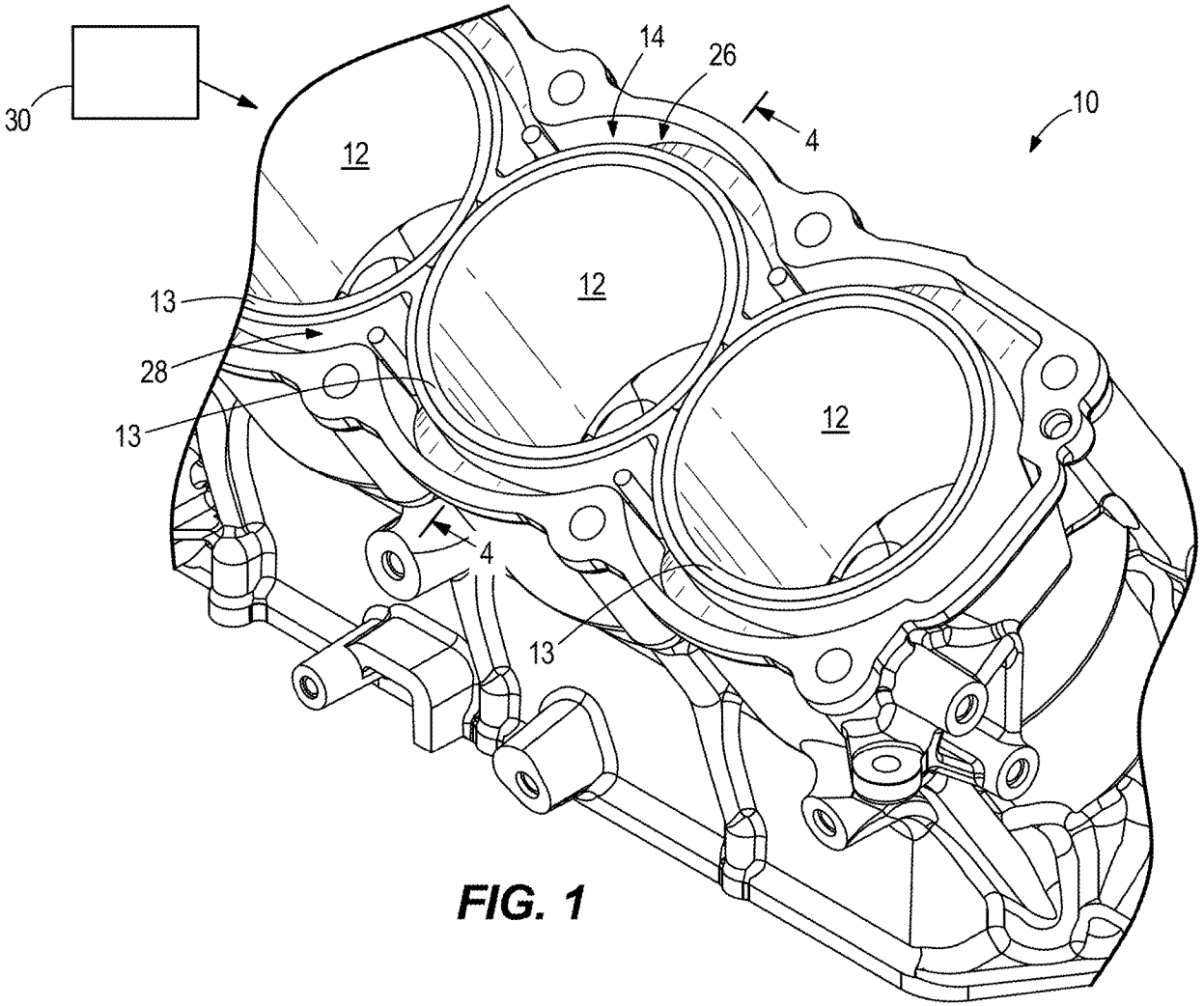
FIG. 1 is a perspective view of a cylinder block having a plurality of cylinders.

FIG. 1 depicts a cylinder block 10 for use in an internal combustion engine for a marine drive, for example an outboard motor or a stern drive. The cylinder block 10 has a plurality of cylinders 12 that can be arranged in a conventional in-line configuration or V-configuration. As is conventional, each cylinder 12 typically has a cylinder liner 13 on its inner diameter, which is abutted by the (not shown) reciprocating piston. A cooling jacket 14 is formed in the cylinder block 10 and extends along and is located radially adjacent to the cylinders 12. The cooling jacket 14 includes a series of passages that are configured to convey cooling fluid, for example cooling water, alongside the outer diameters of the cylinder liners 13 and cylinders 12 so that the relatively cold cooling fluid exchanges heat with the relatively hot cylinder liners 13 and cylinders 12. In this example, the cooling jacket 14 has two cooling jacket passages 26, 28 that are located on opposite sides of the cylinders 12 with respect to each other. A conventional pumping device 30, such as an electrical or mechanical pump, is configured to pump cooling fluid, e.g. cooling water, into the cooling jacket 14 along the first cooling jacket passage 26 on a first side of the cylinders 12 and thereafter along the second cylinder passage 28 on an opposite, second side of the cylinders 12. Similar arrangements for directing cooling fluid through a cooling jacket in a marine drive are well known and disclosed, for example, in the above-incorporated U.S. Pat. No. 8,402,930.

Through research and experimentation, the present inventors have determined that cooling systems for marine engines, particularly open loop cooling systems that pump cooling water from the body of water in which the marine vessel is operating through the engine block, often overcool the liners in the cylinders. This can cause poor fuel preparation, which results in fuel dilution in the engine oil and high hydrocarbon concentration in emissions. The present inventors have also determined that engine cylinders typically generate the most heat at the top and bottom of the cylinder, where the piston dwells (i.e., reverses direction). As such, it would be advantageous to cool the top and bottom of the cylinder bore, where the piston dwells, while not providing as much cooling to the center of the cylinder, where the piston does not dwell. This can alleviate the problems with over-cooling the cylinder liners, as described above. The present disclosure is a result of the present inventors' endeavors to overcome these disadvantages in the prior art.

Referring to FIGS. 4, 7, 10, and 13, the cooling jacket 14 has a top end 16 and a bottom end 18 relative to the centers of the respective cylinders 12. A ledge configuration 40 is formed in the cylinder block 10 in the cooling jacket 14. The ledge configuration 40 extends into the cooling jacket 14 at a location between the top end 16 and bottom end 18. In the illustrated example, the ledge configuration 40 has both inner and outer ledges 22, 24, each being formed in the cylinder block 10 and radially extending into cooling jacket 14 towards each other.

Figure 2:
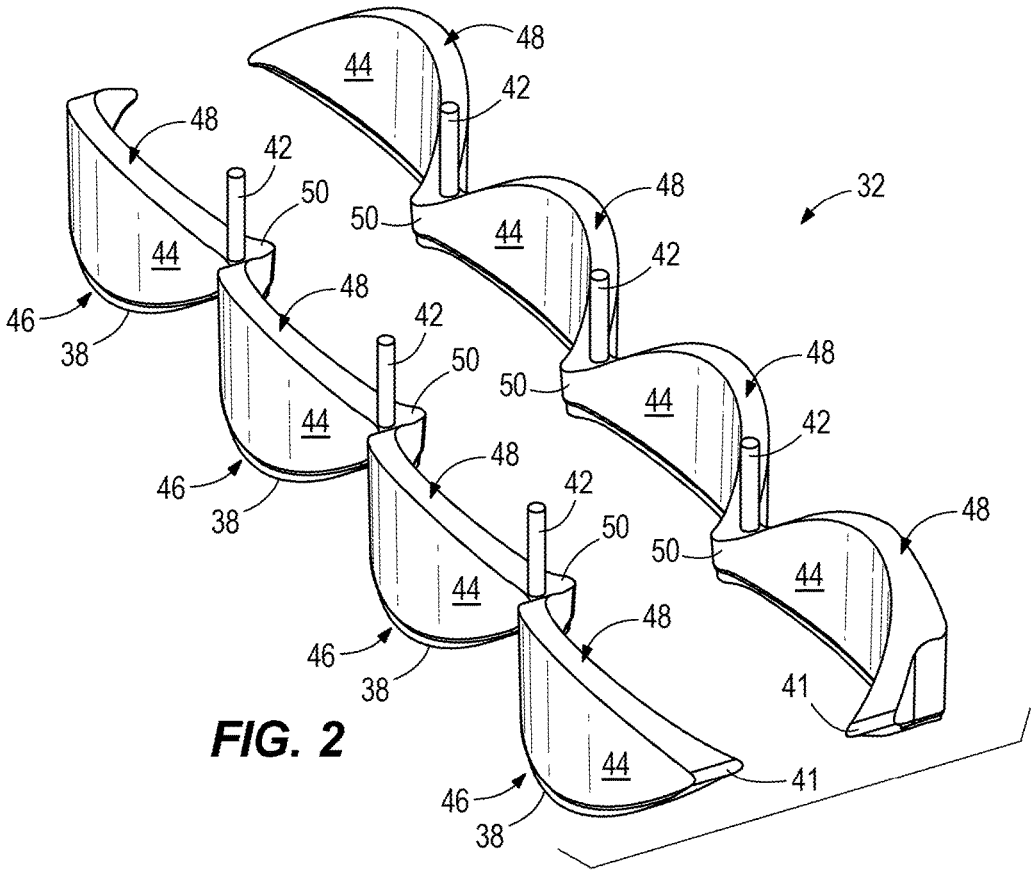
FIG. 2 is a perspective view looking down at a first example of a spacer for directing cooling flow alongside the plurality of cylinders.
Figure 3:
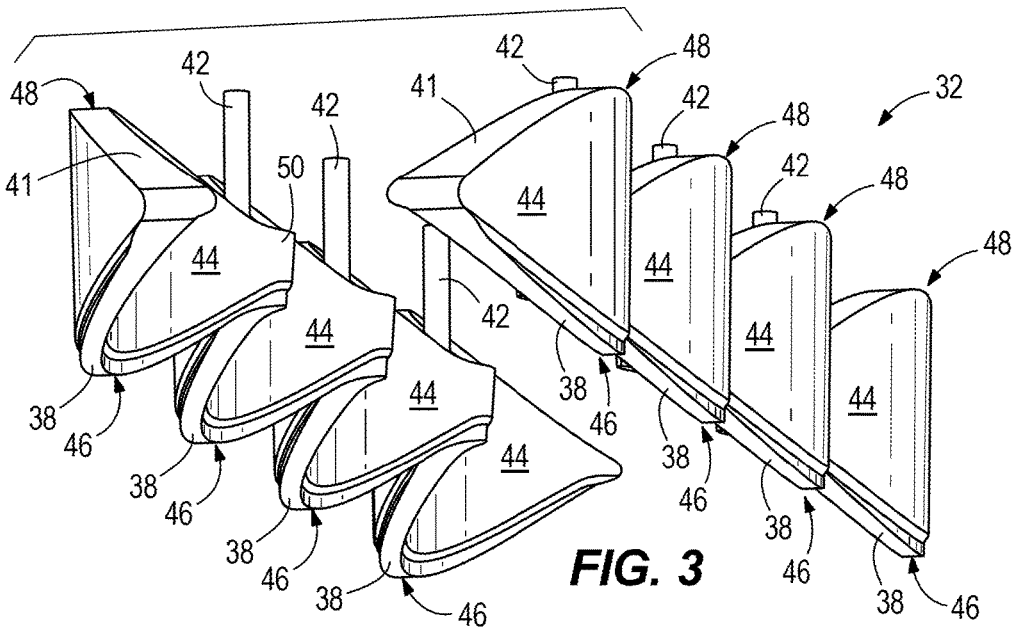
FIG. 3 a perspective view looking up at the first example.
Figure 4:
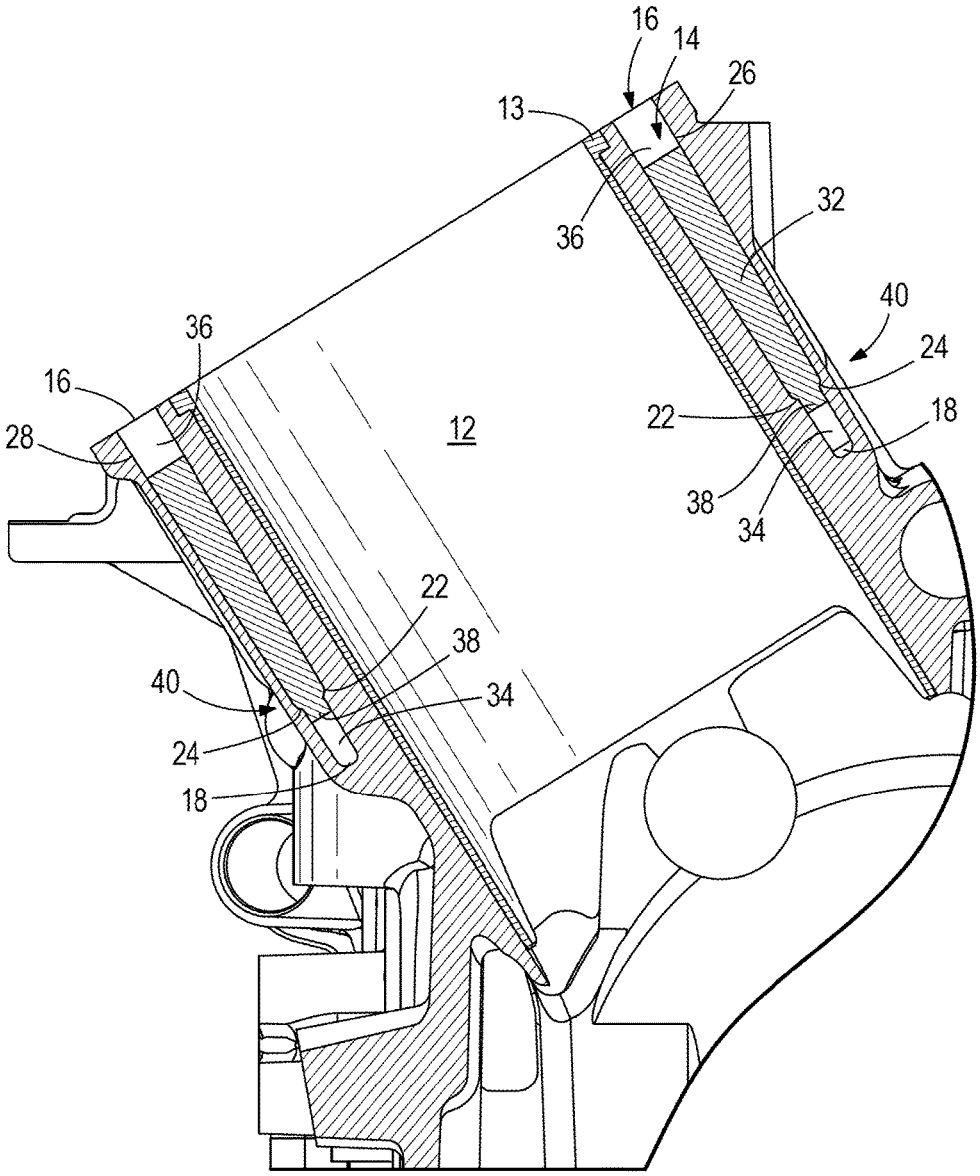
FIG. 4 is a view of section 4-4, taken in FIG. 1, showing the first example.

FIGS. 2-4 depict a first example of a spacer 32 according to the present disclosure. As shown in FIG. 4, the spacer is disposed in the cooling jacket 14 and supported by (i.e. seated on) the ledge configuration 40 so that it remains spaced apart from the bottom end 18 of the cooling jacket 14, thereby advantageously maintaining a lower cooling passage 34 between the spacer 32 and the bottom end 18. As further described below, the spacer 32 also remains spaced apart from the top end 16 of the cooling jacket 14, thereby maintaining an upper cooling passage 36 between the spacer 32 and the top end 16.

In the illustrated example, the spacer 32 has a tapered lower end 38 that extends downwardly past and is seated between the inner and outer ledges 22, 24. Referring to FIGS. 2 and 3, the spacer 32 includes an elongated body 41 and a plurality of legs 42 that extend upwardly from the elongated body 41 and are configured to maintain the elongated body 41 in the seated position shown in FIG. 4 with respect to the ledge configuration 40. More specifically, the legs 42 are elongated and sized so as to engage the top of the cooling jacket 14 (e.g. on a not-shown conventional cylinder head on the cylinder block 10) so that the elongated body 41 cannot drift upwardly in the cooling jacket 14. Rather, the legs 42 force the spacer 32 to remain seated with respect to the ledge configuration 40 so that the noted upper cooling passage 36 is maintained. In this example, the elongated body 41 includes a series of semi-cylindrical sections 44 that are inwardly curved so as to follow an outer curvature of the respective cylinders 12 and respective cooling jacket passages 26, 28. Each semi-cylindrical spacer section 44 has a convex bottom surface 46 that is orientated downwardly (i.e. projects downwardly) towards the bottom end 18 of the cooling jacket 14. Each semi-cylindrical section 44 also has a convex top surface 48 that is orientated upwardly (i.e. projects upwardly) towards the top end 16 of the cooling jacket 14. The legs 42 are interdigitated amongst the semi-cylindrical sections 44 and extend from a juncture 50 located between and connecting adjacent semi-cylindrical sections 44.

In the example shown in FIGS. 2-4, each cylindrical section 44 has opposing sidewalls that are aligned with the sidewalls of the cooling jacket 14. Each semi-cylindrical section 44 can be sized (in relation to the cooling jacket 14) so as to prevent flow of cooling fluid to flow through the cooling jacket 14 radially between the spacer 32 and the sidewalls of the cooling jacket 14. Alternately, each semi-cylindrical section 44 can be sized so as to allow a relatively small amount of cooling fluid to flow through the cooling jacket 14 radially between the spacer 32 and the sidewalls of the cooling jacket 14, as compared to the flow of cooling fluid at the top and bottom ends 16, 18 through the upper and lower cooling passages 34, 36.

Figure 5:
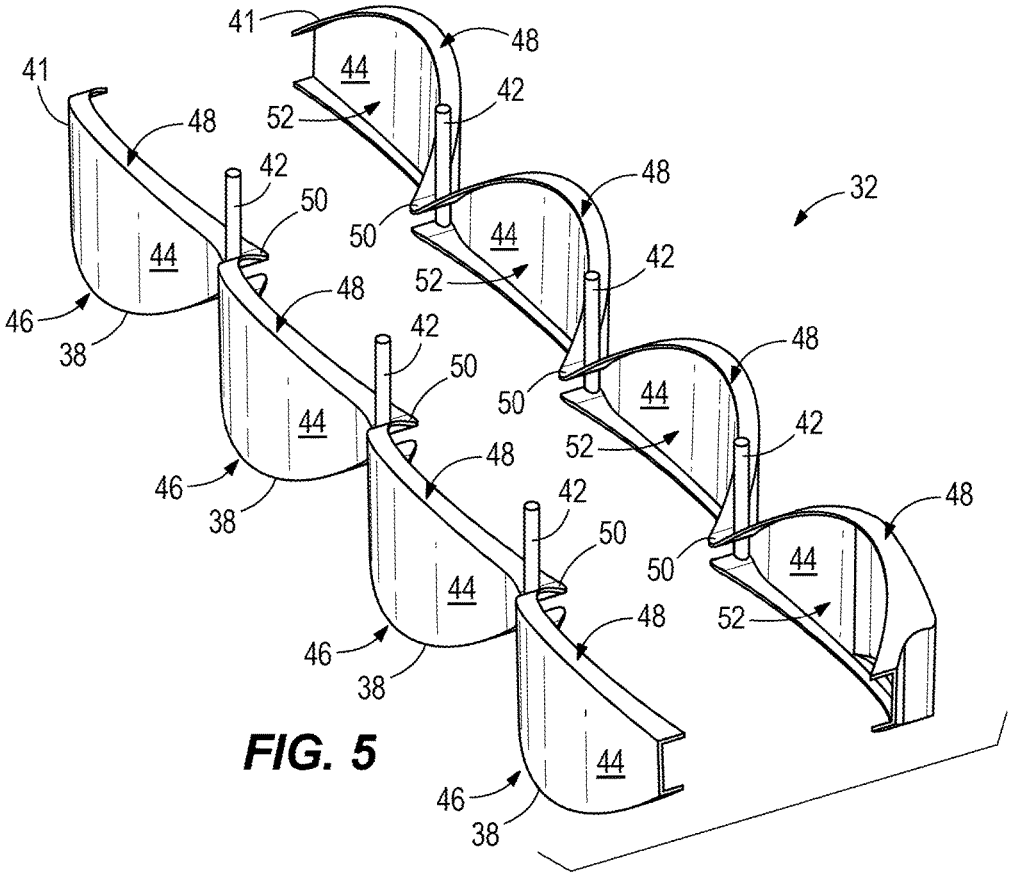
FIG. 5 is a perspective view looking down at a second example of the spacer.
Figure 6:
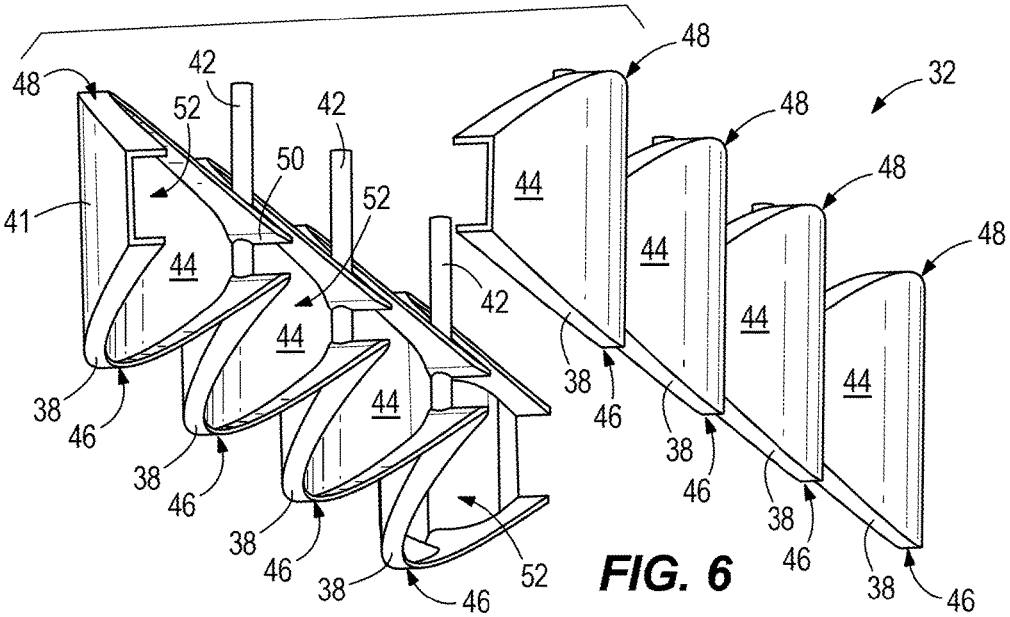
FIG. 6 is a perspective view looking up at the second example.
Figure 7:
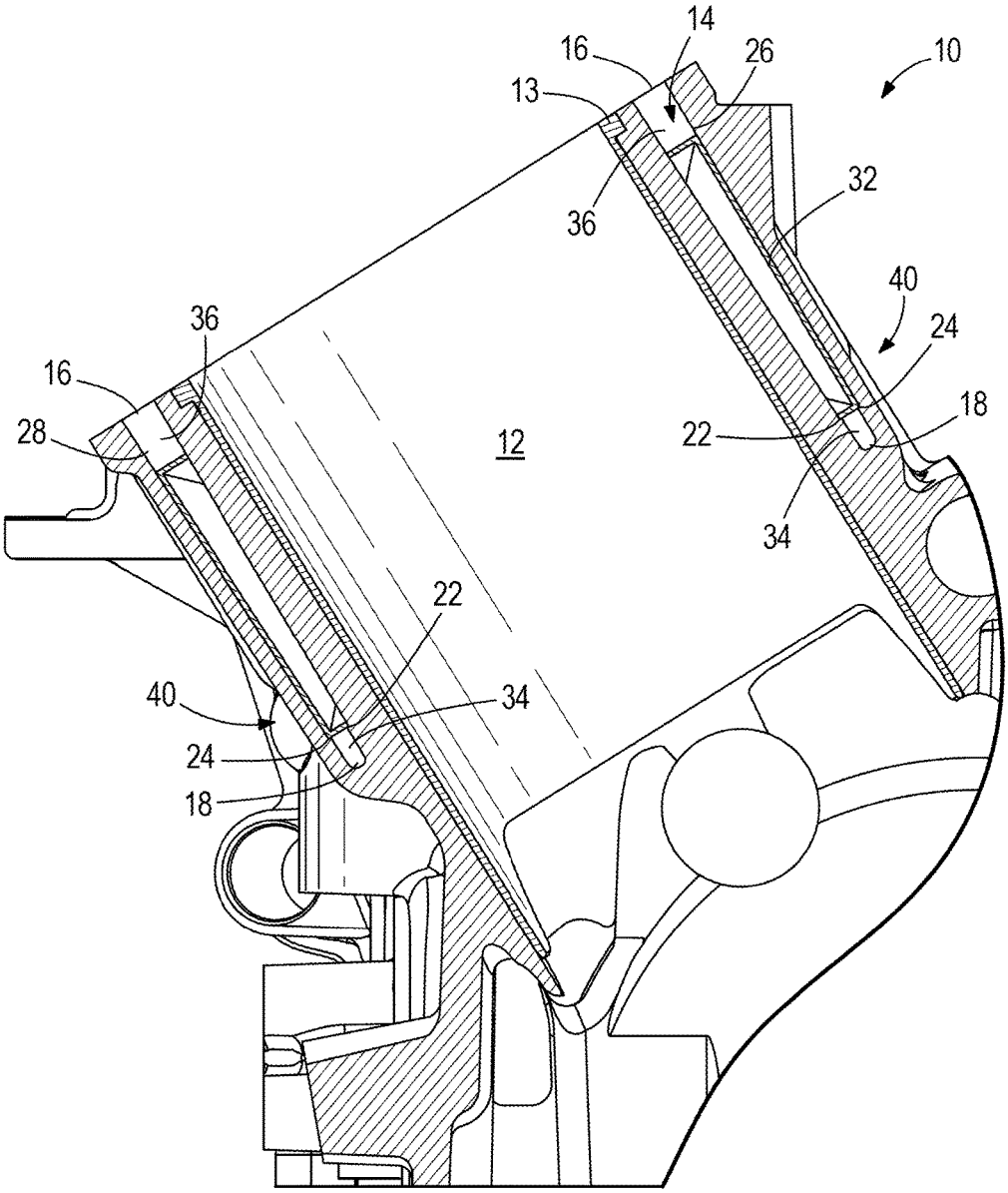
FIG. 7 is a view of section 4-4, taken in FIG. 1, showing the second example.

In the example shown in FIGS. 5-7, each semi-cylindrical section 44 of the spacer 32 forms a cavity 52 that defines an interstice located radially between the elongated body 41 and the opposing sidewalls of the cooling jacket 14, thereby allowing a relatively small amount of cooling fluid to flow through the cooling jacket 14 as compared to the flow of cooling fluid at the top and bottom ends 16, 18. Note that the example shown in FIGS. 5-7 differs from the example shown in FIGS. 1-4, having opposing sidewalls that are aligned with each other without defining an interstice and aligned with the inner sidewalls of the cooling jacket 14.

Figure 8:
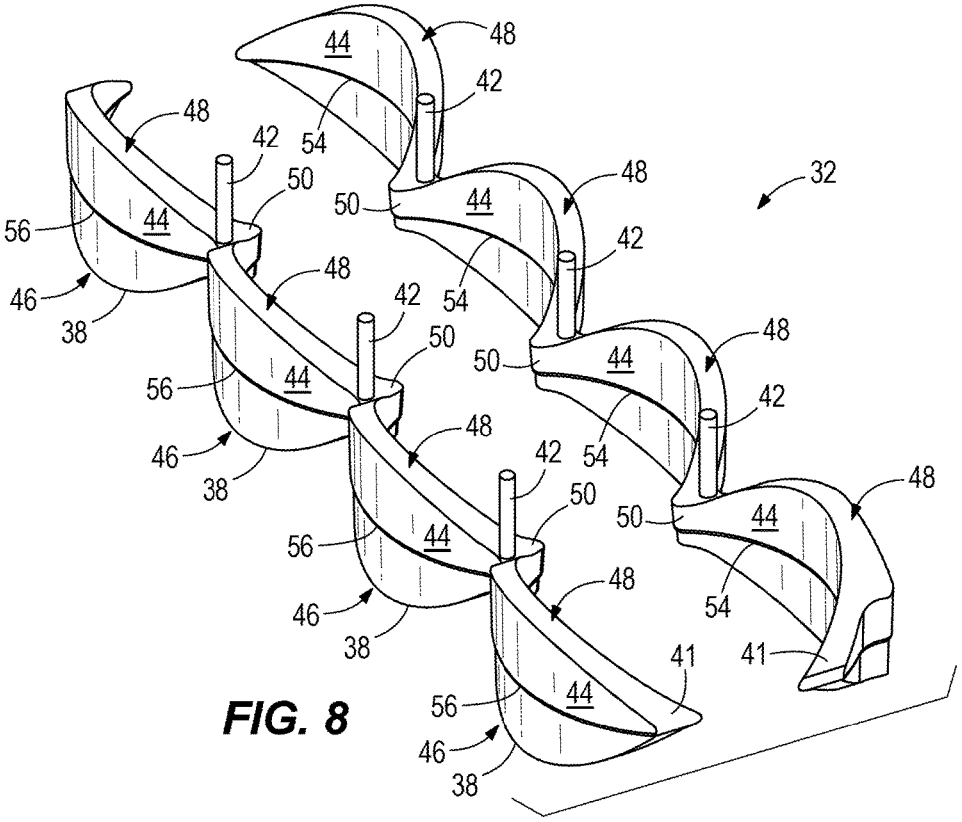
FIG. 8 is a perspective view looking down at a third example of the spacer.
Figure 9:
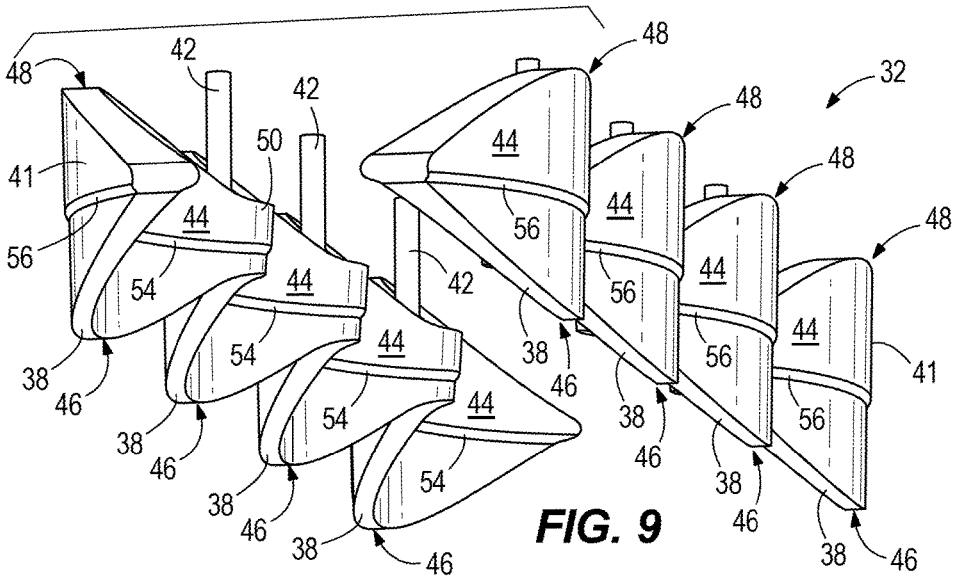
FIG. 9 is a perspective view looking up at the third example.
Figure 10:
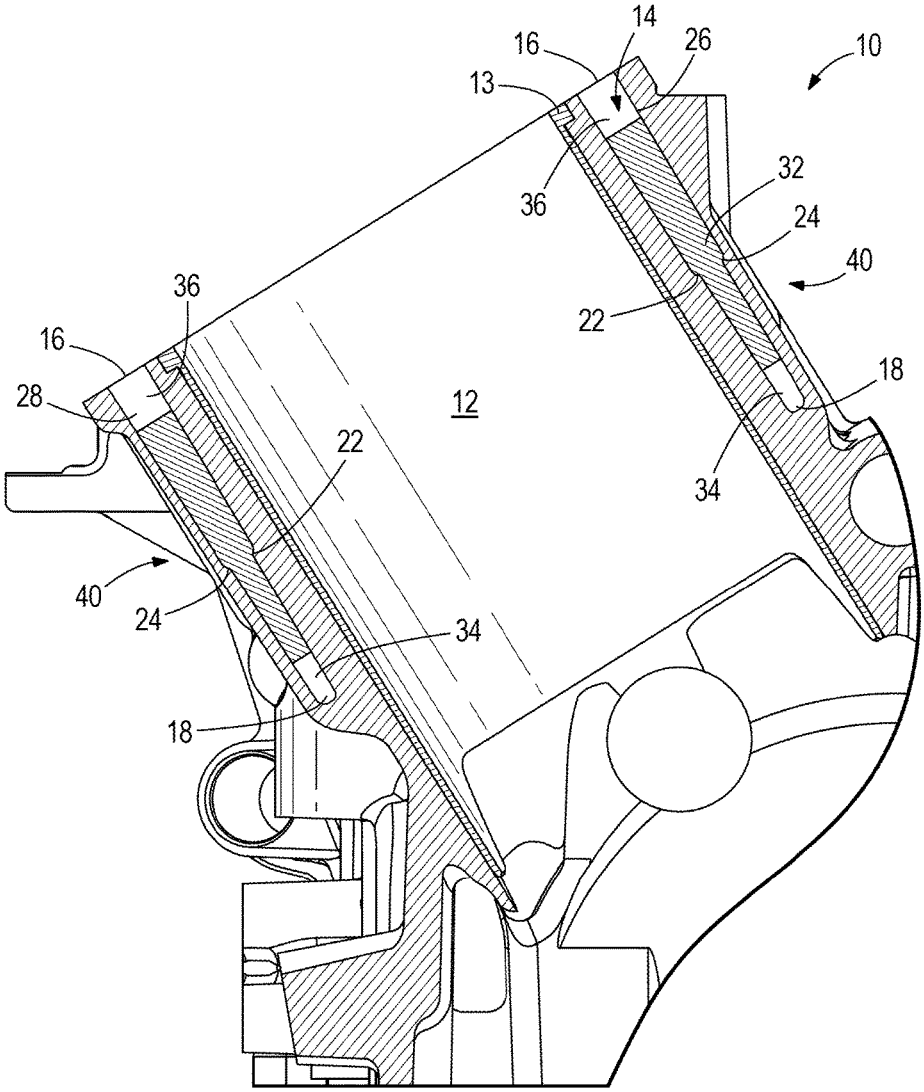
FIG. 10 is a view of section 4-4, taken in FIG. 1, showing the third example.

The example shown in FIGS. 8-10 is similar to the example shown in FIGS. 2-4 except the tapered lower end 38 is longer so that it extends further downwardly past the inner and outer ledges 22, 24. Also, the spacer 32 has inner and outer ledges 54, 56 that extend along the sidewalls of the semi-cylindrical sections 44 and correspond to the inner and outer ledges 22, 24 in the ledge configuration 40. The inner and outer ledges 54, 56 are configured (located, sized and shaped) so that they abut the inner and outer ledges 22, 24 when the spacer 32 is seated in the cooling jacket 14, as shown in FIG. 10.

Figure 11:
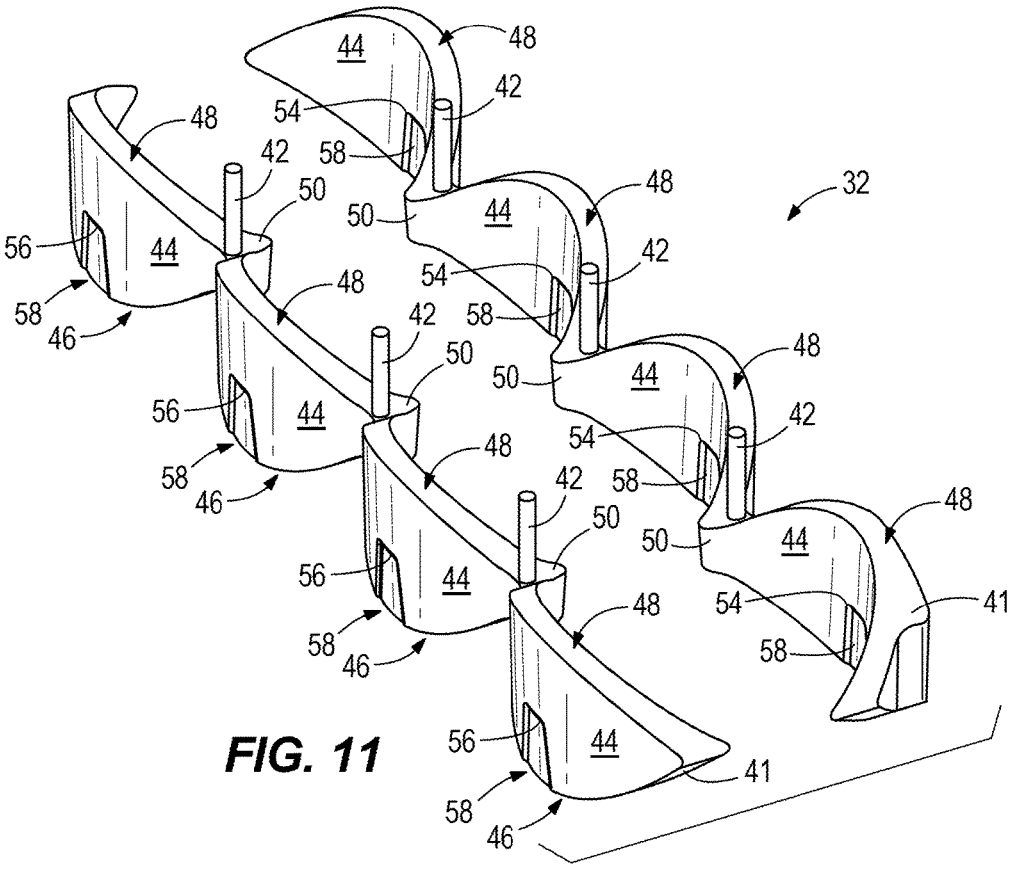
FIG. 11 is a perspective view looking down at a fourth example of the spacer.
Figure 12:
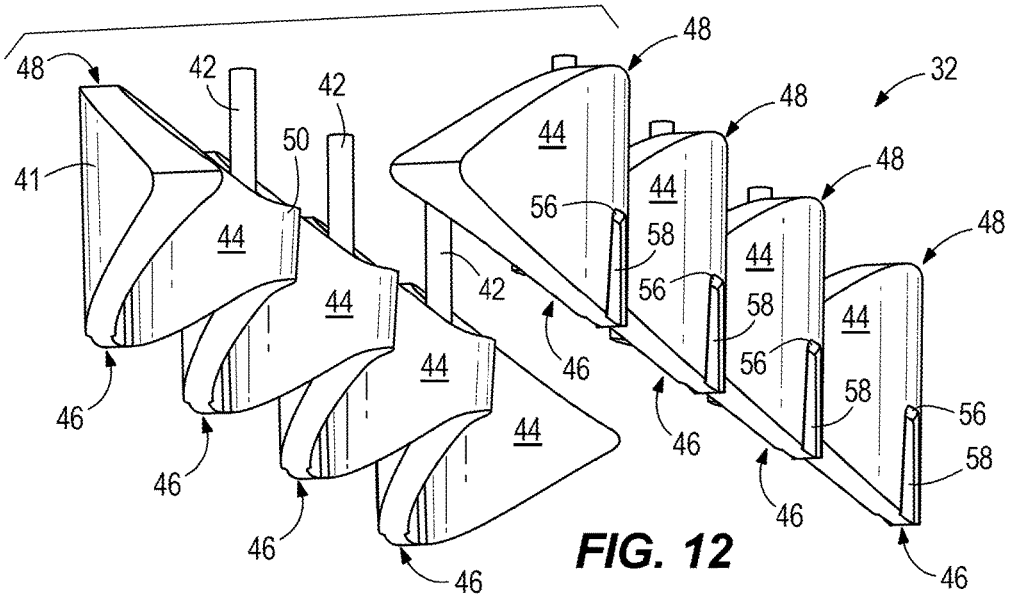
FIG. 12 is a perspective view looking up at the fourth example.
Figure 13:
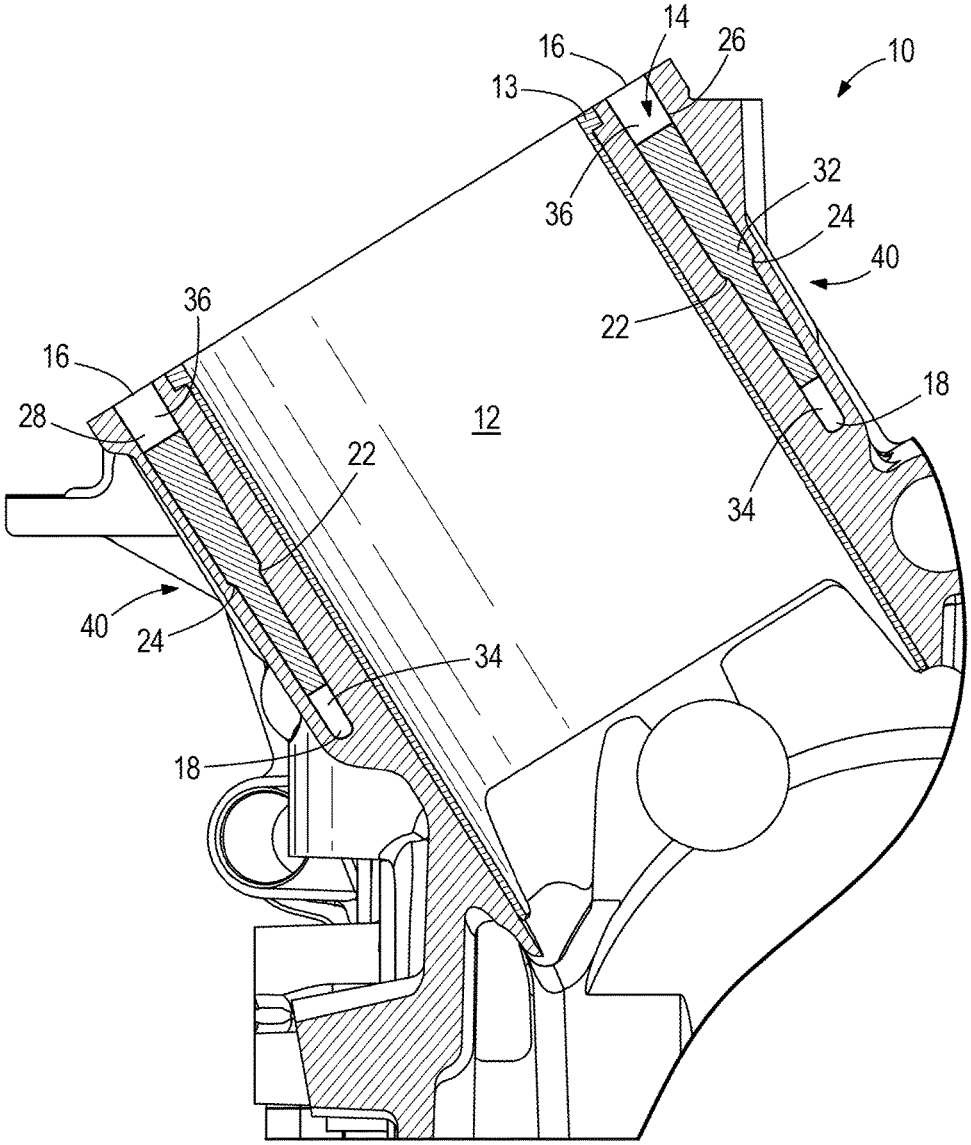
FIG. 13 is a view of section 4-4, taken in FIG. 1, showing the fourth example.

The example shown in FIGS. 11 and 12 is similar to the example shown in FIGS. 8-10, except the inner and outer ledges 54, 56 do not extend along the entire sidewalls of the semi-cylindrical sections 44, but rather are part of a locking recess 58, 60, respectively, that extends upwardly from the tapered lower end 38 of each respective semi-cylindrical section 44. The location, shape and size of the locking recess 58, 60 corresponds to the location, shape and size of the inner and outer ledges 22, 24 in the cooling jacket 14 so that the locking recesses 58, 60 receive the inner and outer ledges 22, 24 when the spacer 32 is inserted into the cooling jacket 14, as shown in FIG. 13. The locking recesses 58, 60 have sidewalls that extend upwardly from the tapered lower end 38 of the respective semi-cylindrical section 44 and each of the inner and outer ledges 22, 24 has corresponding sidewalls that align with the locking recesses 58, 60.

It will thus be seen that the spacer 32 is advantageously configured to allow less flow between the spacer 32 and the cooling jacket 14 than along the top and bottom ends 16, 18. In certain examples, the spacer 32 entirely prevents all flow of cooling fluid alongside the spacer 32 between the spacer 32 and the cooling jacket 14.

According to examples in the present disclosure, the spacer 32 is advantageously configured to either block or slow down flow of cooling fluid in the cooling jacket adjacent to the center of the cylinders—which typically are the coolest locations. The spacer 32 advantageously provides a means for controlling velocity of cooling fluid flow through the center of the cooling jacket. The ledge configuration 40 and its interaction with the spacer 32 advantageously ensures that a precisely sized lower cooling passage is maintained in the cooling jacket, thus enhancing efficiency of the cooling process, while avoiding the need for separating legs on the bottom end of the spacer. The geometry of the spacer can vary from the examples shown, and for example can have a flat lower end across the width of the cylinder or have varying geometry to achieve desired flow velocity and cooling fluid-wetted areas of the liner.

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

What is claimed is:

1. A marine engine comprising:

a cylinder block having a plurality of cylinders;

a cooling jacket formed in the cylinder block and defining a cooling jacket passage configured to convey cooling fluid alongside the plurality of cylinders, the cooling jacket having a top end and a bottom end;

a ledge formed in the cylinder block, the ledge radially extending the cooling jacket passage at a location closer to the bottom end than the top end; and a spacer disposed in the cooling jacket passage and supported by the ledge so that the spacer remains spaced apart from the bottom end, thereby maintaining a lower cooling passage between the spacer and the bottom end;

wherein the spacer comprises an elongated body and a plurality of legs that extend upwardly from the elongated body and maintain the elongated body in a seated position with respect to the ledge; and wherein the body comprises a series of cylindrical sections that are inwardly curved so as to follow an outer curvature of the plurality of cylinders, and wherein the plurality of legs are interdigitated amongst the series of cylindrical sections and extend only towards the top end of the cooling jacket from a juncture between adjacent cylindrical sections in the series of cylindrical sections.

2. The marine engine according to claim 1, wherein the spacer remains spaced apart from the top end, thereby maintaining an upper cooling passage between the spacer and the top end.

3. The marine engine according to claim 1, wherein the ledge is one of inner and outer ledges formed in the cylinder block and radially extending into the cooling jacket towards each other.

4. The marine engine according to claim 3, wherein the spacer comprises a tapered lower end that is sandwiched in a seated position between the inner and outer ledges.

5. The marine engine according to claim 4, wherein the tapered lower end extends downwardly past the inner and outer ledges.

6. The marine engine according to claim 1, wherein each cylindrical section in the series of cylindrical sections has a convex bottom surface that is oriented downwardly towards the bottom end of the cooling jacket.

7. The marine engine according to claim 6, wherein each cylindrical section in the series of cylindrical sections further has a convex top surface that is oriented upwardly towards the top end of the cooling jacket.

8. The marine engine according to claim 1, wherein the elongated body radially abuts opposing internal sidewalls of the cooling jacket in a manner that entirely prevents flow of cooling fluid through the cooling jacket radially between the spacer and the cooling jacket.

9. The marine engine according to claim 1, wherein the elongated body is shaped so that an interstice is defined radially between the elongated body and opposing sidewalls of the cooling jacket, thereby allowing a relatively small amount of cooling fluid to flow through the cooling jacket compared to a flow of cooling fluid at the top and bottom ends of the cooling jacket.

10. The marine engine according to claim 9, wherein the spacer has a cavity that defines part of the interstice.

11. The marine engine according to claim 1, wherein each respective cylindrical section in the series of cylindrical sections has a locking recess that extends upwardly from a lower end each respective cylindrical section, and wherein the ledge in the cooling jacket is received in the locking recess.

12. The marine engine according to claim 1, wherein the spacer is one of a pair of spacers disposed in the cooling jacket, on opposite sides of the plurality of cylinders.

13. The marine engine according to claim 12, wherein the cooling jacket comprises a pair of cooling jacket passages that are located on opposite sides of the plurality of cylinders and containing the pair of spacers.

14. The marine engine according to claim 13, further comprising a pump that pumps cooling fluid along a first side of the plurality of cylinders and thereafter along an opposite, second side of the plurality of cylinders.

15. The marine engine according to claim 1, wherein the spacer allows less flow radially between the spacer and the cooling jacket than along the top and bottom ends.

16. The marine engine according to claim 1, wherein the spacer entirely prevents flow of cooling fluid radially between the spacer and the cooling jacket.

17. The marine engine according to claim 1, wherein the spacer only partially prevents flow of cooling fluid radially between the spacer and the cooling jacket.

* * * * *